United States Patent [19]

Schmidt

[11] 4,105,079

[45] Aug. 8, 1978

[54] DEVICE FOR LAUNCHING PERCUSSION GROUND BORERS

[76] Inventor: Paul Schmidt, Reiherstrasse, Lennestadt-Saalhausen, Fed. Rep. of Germany, 5940

[21] Appl. No.: 766,738

[22] Filed: Feb. 8, 1978

[30] Foreign Application Priority Data

Feb. 2, 1976 [DE] Fed. Rep. of Germany.2605010

[51] Int. Cl.[2] ..... E21C 5/00

[52] U.S. Cl. ..... 173/42; 175/103

[58] Field of Search ..... 61/72.5, 72.6, 72.7; 173/32, 33, 39, 42; 175/94, 103; 248/23; 299/31

[56] References Cited

U.S. PATENT DOCUMENTS

| | | | |
|---|---|---|---|
| 1,028,523 | 6/1912 | Anderson | 61/72.7 X |
| 1,283,702 | 11/1918 | Dunn | 173/39 X |
| 3,151,687 | 10/1964 | Sato et al. | 175/21 |
| 3,354,969 | 11/1967 | Ebeling | 175/103 X |
| 3,814,192 | 6/1974 | Steen | 175/103 X |
| 3,853,182 | 12/1974 | Bourne et al. | 173/33 |
| 4,024,721 | 5/1977 | Takada et al. | 61/72.7 |

FOREIGN PATENT DOCUMENTS

| | | | |
|---|---|---|---|
| 24,473 of | 1909 | United Kingdom | 61/72.7 |

*Primary Examiner*—Lawrence J. Staab

*Attorney, Agent, or Firm*—Toren, McGeady and Stanger

[57] ABSTRACT

A launching device for launching a percussion borer at the start of a ground boring operation comprises a carrier for holding the borer with mounting means which permits the borer to move forwards relative to the carrier in a boring movement but resists backward movement, and a base plate which, in operation, is anchored to the ground and on which the carrier is adjustably mounted. The adjustment of the carrier on the base plate enables the borer to be accurately directed in the correct direction in which the boring is to be made and when the borer is set in operation, rearward impulses on the borer are transmitted through the carrier and the base plate to the ground by which they are counteracted.

16 Claims, 3 Drawing Figures

DEVICE FOR LAUNCHING PERCUSSION GROUND BORERS

Percussion borers for boring holes in the form of small tunnels in the ground are used principally for laying supply lines, for example water-pipes, electrical cables and telephone lines under roads, embankments or footways, without it being necessary to excavate the surface of the road or footway. For this purpose, the percussion borer, which is usually pneumatically driven, moves through the ground, the soil in front of the borer being displaced sideways and the borer leaving behind it a hole, into which the supply lines can be drawn either immediately behind the borer or later.

Existing percussion borers have a percussion bit mounted in the front end of a housing and a piston which is slidable to and fro in the housing to strike the percussion bit, the piston being operated by compressed air. When the piston is accelerated forwards a backward impulse is produced and this is counteracted by friction between the outside of the housing and the surrounding ground as the percussion bit is driven forwards in the ground. When the percussion borer is started up at the beginning of a bore, this backward impulse must be counteracted, even though at this stage the housing is not within the ground. In practice, the usual technique for counteracting the backward impulse has been to make use of a support in the form of a stake, which is driven into the ground behind the borer and is used as a lever acting on the borer. This technique is not only complicated and time-consuming, but also usually makes it impossible to align the borer accurately on to a target and at the same time to counteract the backward impulse correctly.

The aim of the present invention is to provide a launching device for supporting a percussion borer at the start of a boring operation to withstand the backward impulse of the borer and permit launching of the borer in an extremely simple and convenient manner with good target alignment.

To this end, such a device comprises a carrier for holding the borer, means for mounting the borer on the carrier, the mounting means being adapted to permit forward movement of the borer relative to the carrier, but to resist backward movement of the borer relative to the carrier, and means for anchoring the carrier to the ground whereby backward impulses on the borer are transmitted through the carrier and counteracted by reaction forces from the ground.

The device in accordance with the invention enables the launching of the percussion borer to be carried out very easily and simply, since the percussion borer can not only be very easily aimed at the desired target, but in addition the backward impulse occurring at launching is satisfactorily counteracted.

In a preferred embodiment of this invention, the carrier comprises a trough which is arranged to receive the borer and is supported on a base plate and a braking device which allows forward but prevents backward movement of the percussion borer on the trough. The device thus consists of comparatively few components, while satisfying the requirements of easy and convenient handling with accurate alignment of the borer on to a target on the one hand and a satisfactory resistance to the backward impulse force on the other hand.

Preferably, the trough consists of a bearing shell substantially of semi-cylindrical or prismatic cross-section, extending longitudinally of the base plate. This therefore provides a very good seating for the percussion borer, which normally has a cylindrical housing.

It would in essence be possible to align the base plate in the desired position relative to the ground by bottom bearers. This would however be very complicated. Therefore, preferably, the trough or bearing shell is angularly adjustable relative to the base plate in vertical and/or horizontal directions. In this way, the desired alignment of the trough or bearing shell together with the percussion borer resting thereon can be achieved both in elevation and direction by simple adjustment of the trough or bearing shell. This is assisted by the fact that, according to a further preferred feature of the invention, the trough or shell is pivotal relative to the base plate about a substantially vertical axis near its forward end. Together with the adjustment in elevation and traverse, a carrier is therefore obtained, in which the trough or bearing shell is universally angularly adjustable in every direction. For this purpose, the trough or bearing shell only needs to be pivotally mounted at its forward end in the manner of a universal joint.

The adjustment of the bearing shell relative to the base plate can be carried out in various ways. The height adjustment for example can be obtained by a strap which is fixed to the underside of the trough or bearing shell, the strap having near to its ends, which project on both sides beyond the trough or bearing shell, screw-threaded bores receiving adjusting screws which bear on the base plate to enable vertical adjustment of the trough or shell to be effected. By rotating these adjustment screws the bearing shell can be set to the desired elevation.

The supporting of the trough or bearing shell from the base plate is preferably effected by a supporting plate which is hinged to the strap and the other end of the supporting plate bears against a part fixed to the base plate. For the part fixed to the base plate, a rod may preferably be used and this is preferably releasably clamped between straps fixed to the base plate and is preferably serrated. When setting the bearing shell in the horizontal direction, the end of the supporting plate is then guided along the serrations of the rod, which is bent to a circular arc.

The backward impulse when launching the percussion borer may be counteracted in a simple manner by an arrangement in which the braking device consists of a braking roll which is free to rotate in the forward feed direction of the borer but non-rotatable in an opposite direction. The braking roll is preferably of concave axial section and thus fits a cylindrical housing of the percussion borer. The braking roll is preferably adjustably journalled in a mounting and this mounting may comprise a substantially U-shaped mounting frame fixed to the bearing shell.

A constructionally very simple setting of the braking roll is obtained if this roll is journalled to pivot at one end in one side arm of the U-shaped mounting frame and is height-adjustable at its other end in the other side arm of the mounting frame by means of a spring and a capstan head screw. The pivotal bearing of the braking roll enables the percussion borer to be easily laid upon the trough or bearing shell and enables the roll then to be easily placed upon the bore from above, a sufficient pressure then being applied on to the percussion borer by means of the capstan head screw to hold the borer in position on the trough or shell.

An example of a launching device in accordance with the invention will now be described with reference to the accompanying drawings, in which.

Figure 1:
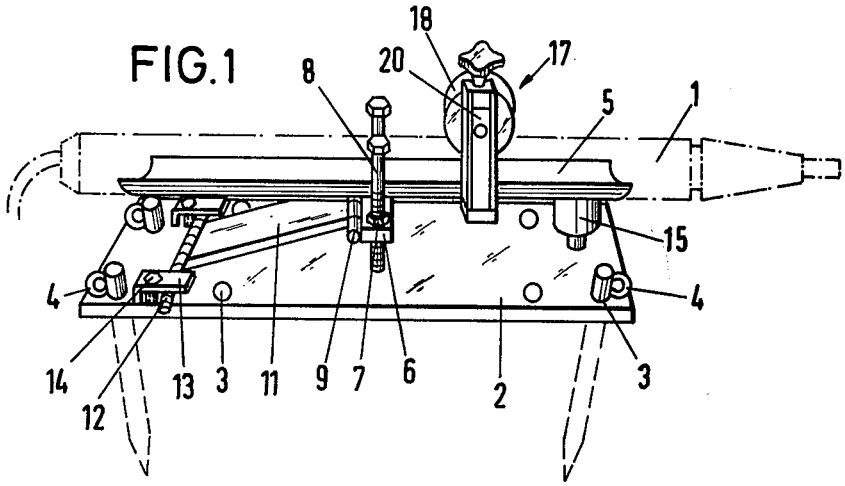
FIG. 1 is a perspective view of the device from above and from one side.

The launching device, which launches a percussion borer 1 shown in chain-dotted lines in FIG. 1, comprises a base plate 2, which is anchored in the ground by means of ground anchor pegs 4 driven through openings 3 in the base plate. Above the base plate 2 and extending in the longitudinal direction of the base plate is a semi-cylindrical bearing shell or trough 5 forming a carrier to the lower face of which a strap 6 is welded. Near the ends of the strap 6, which project on either side of the bearing shell 5, threaded bores 7 are situated, through which adjustment screws 8 are screwed and bear against the base plate 2. A support plate 11 is attached to one end of the strap 6 by a hinge 9. The support plate 11 bears at its other end against a rod 12, which is furnished with serrations and lies on a circular arc, this rod being firmly clamped in position by straps 13 fixed to the base plate 2 and by clamping screws 14. Whereas the straps 13 are close to one end of the base plate 2 and the strap 6 is fixed near the middle of the bearing shell 5, the bearing shell 5 is supported at its forward end by means of a pivoting head 15, which is universally pivotable. This makes rotational and pivoting movement of the front end of the shell 5 possible.

Figure 2:
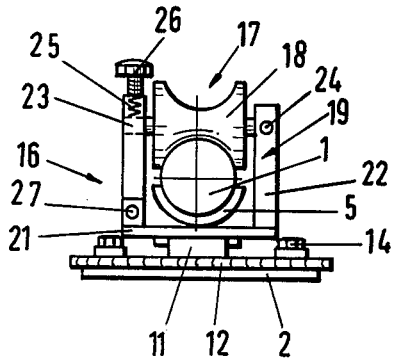
FIG. 2 is a front elevation.
Figure 3:
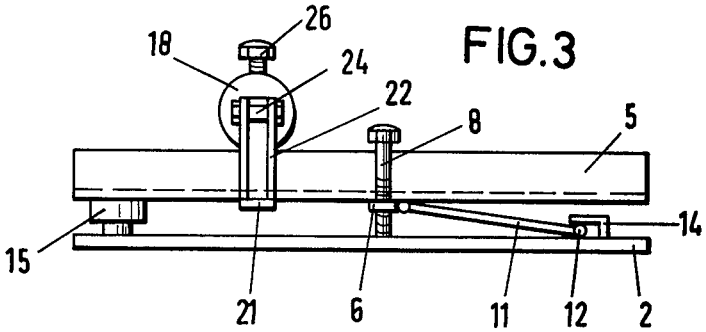
FIG. 3 is an elevation of the other side.

Between the pivoting head 15 and the strap 6, a braking device 17 is mounted upon the bearing shell 5 by means of a mounting 16. The braking device 17 consists basically of a braking roll 18, concave in axial section, which is journalled in the mounting 16 to rotate freely in a forward feed direction of the borer but is prevented from rotating in a rearward direction. As can be seen from FIG. 2, in use, the braking roll 18 bears with the lower part of its periphery against the percussion borer 1. The mounting 16 comprises a U-shaped mounting frame 19, which in turn includes a transverse web 21, welded to the underside of the bearing shell 5, and two vertical arms 22, 23. The braking roll 18 is pivotally journalled in one arm 22 by means of a pin 24, while it is journalled in the other arm 23 of the mounting frame 19 in a height-adjustable manner, by means of a spring 25 and a capstan head screw 26. The arm 23 of the mounting frame, which is situated on the height-adjustable side of the braking roll 18, is pivotally journalled by a pin 27 on the transverse web 21 of the mounting frame 19.

At the site in which the beginning of a hole is to be bored, the base plate 2 is anchored firmly in the ground by means of the ground anchor pins 4. Then, with the arm 23 of the mounting frame 19 folded outwards and the braking roll 18 swung upwards and outwards, the percussion borer 1 is placed from above into the bearing shell 5. The carrier formed by the shell 5 is then adjusted to align the borer on to the target. This is done in elevation by adjustment of the adjusting screws 8 and in a direction transversely by lateral pivoting of the shell 5 about the pivoting head 15 with the rear end of the supporting plate 11 sliding along the rod 12. The launching device is then ready for launching the borer and the borer can be put in operation.

In the region of the pivoting head 15, an angular scale may be disposed, which in conjunction with a spirit level indicates the angle of inclination of the carrier shell 5. The semi-cylindrical bearing shell 5 can of course be of other cross-sections, for example prismatic so long as it holds the borer firmly in position.

I claim:

1. A launching device for launching a percussion borer at the start of a ground boring operation, said device comprising a carrier for holding said borer, mounting means for mounting said borer on said carrier, said mounting means being adapted to permit forward movement of said borer relative to said carrier but to resist backward movement of said borer relative to said carrier, means for anchoring said carrier to said ground whereby backward impulses on said borer resulting from percussive operation of said borer are transmitted through said carrier and are counteracted by reaction forces from said ground, said carrier comprises a trough for receiving said borer, said trough having a forward end and a rearward end so that the forward movement of the borer is in the direction from the rearward end toward the forward end of said trough, a base plate adapted to be anchored to said ground, and means for adjustably supporting said trough from said base plate, said mounting means including braking means for braking movement of said borer relative to said trough to permit said forward movement but resist said backward movement to said borer in said trough, said means for supporting said trough from said base plate includes angular adjusting means whereby said trough is angularly adjustable relative to said base plate in vertical and horizontal directions, and means adjacent the forward end of said trough forwardly of said angular adjusting means for pivotally mounting said trough on said base plate, said means adjacent the forward end limiting said forward end to angular movement about vertical and horizontal axes relative to said base plate.

2. A device as claimed in claim 1, wherein said trough comprises bearing shell means of substantially semi-cylindrical or prismatic cross-section, said base plate being elongate and said bearing shell extending longitudinally of said base plate.

3. A device as claimed in claim 1, wherein said means pivotally mounting said trough on said base plate includes universal pivoting head means whereby said trough is universally pivotable relative to said base plate.

4. A device as claimed in claim 1, wherein said means for anchoring said carrier to the ground comprises means defining holes through said base plate and ground anchor pins adapted to be driven through said holes into said ground.

5. A launching device for launching a percussion borer at the start of a ground boring operation, said device comprising a carrier for holding said borer, mounting means for mounting said borer on said carrier, said mounting means being adapted to permit forward movement of said borer relative to said carrier but to resist backward movement of said borer relative to said carrier, means for anchoring said carrier to said ground whereby backward impulses on said borer resulting from percussive operation of said borer are transmitted through said carrier and are counteracted by reaction forces from said ground, said carrier comprises a trough for receiving said borer, a base plate adapted to be anchored to said ground, means supporting said trough from said base plate, said mounting means including braking means for braking movement of said borer relative to said trough to permit said forward movement but resist said backward movement of said borer in said trough, said means for supporting said trough from said base plate includes angular adjusting means whereby said trough is angularly adjustable relative to said base plate in vertical and horizontal directions, a strap fixed to the underside of said trough, the ends of said strap projecting laterally beyond both sides of said trough, means defining screw-threaded bores in said projecting ends of said strap, and adjusting screws screwed through said bores into engagement with said base plate to enable said trough to be adjusted vertically in position relative to said base plate.

6. A device as claimed in claim 5, further comprising a supporting plate, means hinging one end of said plate to said strap, a part fixed to said base plate and the other end of said supporting plate bearing against said part.

7. A device as claimed in claim 6, wherein said part fixed to said base plate is a rod and further comprising additional straps fixed to said base plate and clamping means releasably clamping said straps to said rod.

8. A device as claimed in claim 7, wherein said rod is serrated.

9. A device as claimed in claim 7, wherein said straps fixed to said base plate are located near a rearward end of said base plate and said strap which is fixed to said trough is located near the middle of the length of said trough.

10. A launching device for launching a percussion borer at the start of a ground boring operation, said device comprising a carrier for holding said borer, mounting means for mounting said borer on said carrier, said mounting means being adapted to permit forward movement of said borer relative to said carrier but to resist backward movement of said borer relative to said carrier, means for anchoring said carrier to said ground whereby backward impulses on said borer resulting from percussive operation of said borer are transmitted through said carrier and are counteracted by reaction forces from said, ground said carrier comprises a trough for receiving said borer, a base plate adapted to be anchored to said ground, and means supporting said trough from said base plate, said mounting means including braking means for braking movement of said borer relative to said trough to permit said forward movement but resist said backward movement of said borer in said trough, and said bracking device includes a braking roll and means rotatably mounting said braking roll on said trough, said rotatable mounting means including means to permit free rotation of said roll in a forward feed direction of said borer, and means to prevent rotation of said roll in a direction backward of said borer.

11. A device as claimed in claim 10, in which said braking roll has a concave surface shape as seen in axial section.

12. A device as claimed in claim 10, further comprising means adjustably mounting said braking roll for adjustment in position towards and away from said trough.

13. A device as claimed in claim 12, wherein said means mounting said braking roll comprises a substantially U-shaped mounting frame and means fixing said mounting frame to said trough.

14. A device as claimed in claim 13, wherein said U-shaped mounting frame includes a first side arm and a second side arm, means journalling said braking roll to one end of said one side arm and means attaching said braking roll to said second side arm, said means attaching said braking roll to said second side arm including height adjusting means including a spring and capstan head screw means.

15. A device as claimed in claim 14, wherein said second side arm includes means defining a longitudinal slit therein.

16. A device according to claim 15, wherein said U-shaped frame further comprises transverse web means forming a base of said U and means pivotally connecting said second side arm to said transverse web means and means rigidly fixing said first side arm to said web means.

* * * * *

UNITED STATES PATENT OFFICE

CERTIFICATE OF CORRECTION

Patent No. 4,105,079 Dated August 8, 1978

Inventor(s) PAUL SCHMIDT

It is certified that error appears in the above-identified patent and that said Letters Patent are hereby corrected as shown below:

In the heading of the Patent [22] and [30] should read as follows

[22] Filed: Feb. 8, 1977

[30] Foreign Application Priority Data

Feb. 10, 1976 .....[DE] Fed. Rep. of Germany / 2605010

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*